United States Patent [19]

Lin

[11] 4,028,771

[45] June 14, 1977

[54] THIN FLAT ERASER AND HOLDER

[76] Inventor: Jau-Guang Lin, 103 Elmere Rd., Owings Mills, Md. 21117

[22] Filed: Mar. 15, 1976

[21] Appl. No.: 666,972

[52] U.S. Cl. ..... 15/434

[51] Int. Cl.[2] ..... B43L 19/00

[58] Field of Search .... 15/424, 425, 427, 431–434, 15/105.51, 105.52, 105.53; 51/392; 401/92

[56] References Cited

UNITED STATES PATENTS

| | | | |
|---|---|---|---|
| 578,289 | 3/1897 | Ekholm | 15/105.52 |
| 931,405 | 8/1909 | Frederick | 15/434 |
| 1,028,034 | 5/1912 | Kruger | 15/434 |
| 1,703,603 | 4/1929 | Stuart | 15/434 X |
| 2,115,806 | 5/1938 | Frederick | 15/433 |
| 2,136,093 | 11/1938 | Voight | 15/434 |
| 2,261,314 | 11/1941 | Vogel | 15/434 |

FOREIGN PATENTS OR APPLICATIONS

| | | | |
|---|---|---|---|
| 440,966 | 2/1927 | Germany | 15/434 |

*Primary Examiner*—Daniel Blum

*Attorney, Agent, or Firm*—John F. McClellan, Sr.

[57] ABSTRACT

An eraser device comprising a thin flat rubberlike erasing material and a stiff plastic holder structure therefor, the latter having a trough shape holder bottom locking together by snap clips with an inverted trough shape front cover and an inverted trough shape rear cover so as to form a clamping front end and a rear storage space. The thin flat eraser is clamped firmly at the front end so as to eliminate requirement of exerting extra force or paying special attention to the holder in order to prevent the eraser from slipping backward in the erasing operation. Additionally, the holder structure provides a smooth surface for comfortably grasping the eraser device in the hand. As the eraser front end is worn in use, it can be easily adjusted to maintain the proper protrusion by releasing the clamp action of the front cover. Refilling of long flexible thin eraser can be easily accomplished by removal of both front and rear covers. Double erasing ends can be easily formed by providing a clamping zone at each end of the holder and two separated pieces of erasing material.

4 Claims, 8 Drawing Figures

THIN FLAT ERASER AND HOLDER

BACKGROUND

This invention relates to improvement in eraser holder in which a thin flat eraser is held with a clamping front end, and in which the protruding end of the eraser can be adjusted.

A thin flat rubber-like eraser has definite advantages over the thick bar erasers which still prevail in the market. A thick bar eraser requires frequent sharpening to keep the edge sharp in order to do proper erasing work, and it often requires a sharp blade in the sharpening process, so the danger of cutting the finger increases, this is particularly true for younger users, also much of the erasing material is wasted in the sharpening process, at last it is usually thrown away before even half of its body is utilized, because it becomes too short for the hand to hold comfortably.

With a thin flat eraser the trouble of sharpening can practically be eliminated, and also most of the erasing material can be utilized, even so it still has not gained popularity in the market, because a type of eraser holder acceptable to the general users is still not available.

SUMMARY

My improved eraser device generally comprises a thin flat erasing material which is clamped firmly within a plastic holder. In operative position the user needs not pay special attention or exert extra force on the holder to keep the eraser body from slipping backward. The device works like a solid unit.

Therefore it is an important object of my invention to provide a thin flat eraser holder which in operative position is smooth and stiff for the hand to hold comfortably.

It is also an important object of my invention to provide an eraser holder in which the protruding end of the thin flat eraser can be easily adjusted when the clamping front cover is removed.

It is still an object of my invention to provide a clamping front cover which can be removed and can be put back to its clamping position easily.

It is a further object of my invention to provide a clamping front end which in operative position can hold the eraser body firmly and keep it from slipping backward and wobbling.

It is still a further object of this invention to provide a removable rear cover in order to ease the effort in the eraser refilling process, also to simplify manufacturing process of the holder.

Additional objects and advantages of this invention will appear as the detailed description proceeds.

BRIEF DESCRIPTION OF THE DRAWINGS

Referring to the accompanying drawings, a particular embodiment of the present invention is illustrated, wherein.

DETAILED DESCRIPTION OF THE PREFERRED EMBODIMENT

Figure 1:
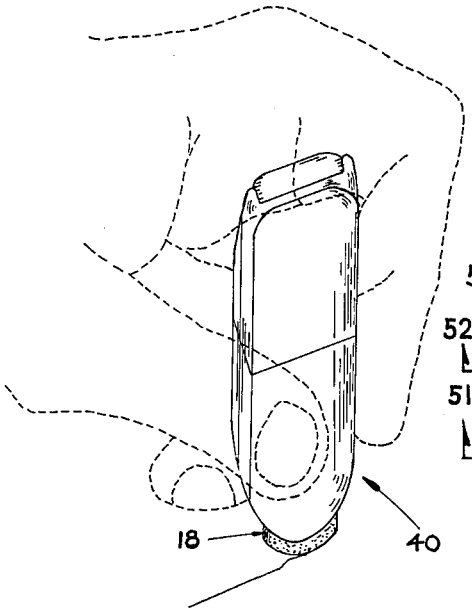
FIG. 1 is a perspective view showing my novel eraser device erasing a faulty pencil line.

Referring to FIG. 1 the improved erasing device of my invention comprises a holder designated generally by the numeral 40, and a thin flat eraser 18 supported in the holder.

Figure 2:
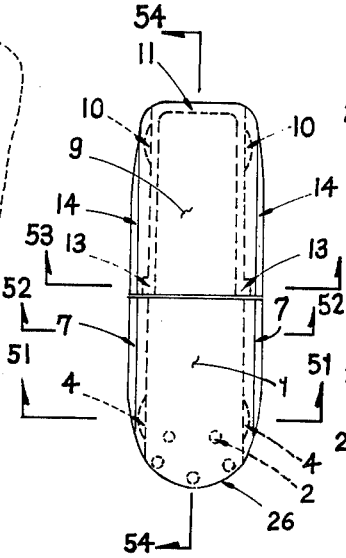
FIG. 2 is a top plan view of the front cover lining up with the rear cover, they are removed from the holder bottom of FIG. 3.
Figure 3:
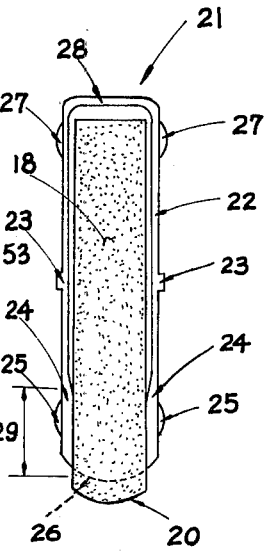
FIG. 3 is a top plan view of the eraser holder bottom with a thin flat eraser.

Referring particularly to FIG. 2 and FIG. 3, the preferred form of my invention is shown in detail. A trough shape holder bottom 21 with a horizontally curved front end 26 locks together with the front cover 1 and the rear cover 9 by the locking action of two pairs of snap clips 4,25 and 10, 27. Alternatively, these may respectively be called first, second, third and fourth engaging structures. The small raised dots or projections 2 underneath the front cover 1, and the inside face of the holder bottom 21 form a clamp action for the thin flat eraser 18 in the direction perpendicular to the thin body of the erasing material, the dots 2 will tenderly deform the elastic eraser body 18 and create a firm clamp action when the front cover 1 locks together with the holder bottom 21, this action can be easily accomplished when the user's fingers press together the cover 1 and the holder bottom 21 with moderate pressure. The side walls 24 at front end of the holder bottom 21 are thicker than the remaining portion of side walls 22 and protrude to form a narrower space which just fits the eraser body 18 snugly tight, and induces friction resistance at the contact surfaces, it creates a clamp action in the transverse direction of the thin flat eraser. These two perpendicular clamp actions are confined to the clamping zone 29 in front of the holder 40, the remaining portion of eraser holder has bigger interior space to serve as storage room for the eraser body 18. The front cover 1 when in operative position, butts against the cover stops or lugs 23 which are covered by the notches 13 underneath the rear cover 9, the cover stops 23 also serve as cover position indicators to let the covers 1 and 9 return to their correct position easily. Both the front and rear covers have their side walls 7 and 14 smoothly flared outward, in order for the user's finger to press against, in the cover removing process, the easiest way of removing the front cover is one hand holding the rear part of the eraser holder, and the other hand twisting upward the front cover 1 with the thumb pressing against one of the cover side walls 7, the index finger staying on top of the cover 1, and the middle finger clamping at the other cover side wall 7. The removal of the rear cover can be done easily in similar way.

The horizontally curved front ends 26 and 20 of the holder 40 and the eraser body 18 make the erasing device able to work in inclined position without any sharp holder corner scratching the paper, so it can fit each user's handling habit easily.

The rear walls 28 and 11 are for enclosure purpose, also form a smooth holder surface, they shall be eliminated for eraser device with double erasing ends.

FIG. 4 to FIG. 7 are enlarged sections to show clearly the details of my improved erasing device.

Figure 8:
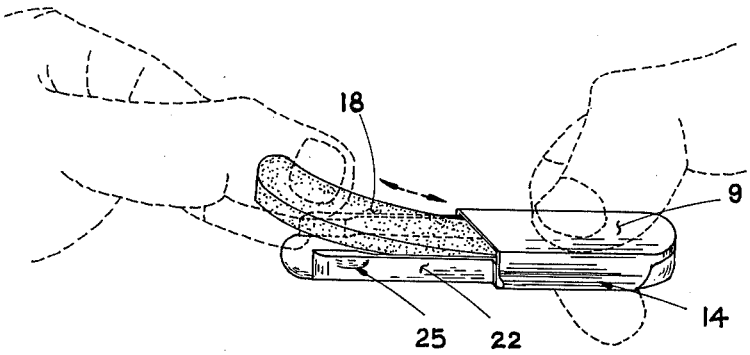
FIG. 8 is a perspective view of the erasing device showing the action of eraser protruding end adjustment.

Referring particularly to FIG. 8, in order to make easier the eraser protruding end adjustment, the front cover 1 should be twisted off first, then lift up the front end 20 of the eraser body 18 to clear the clamping side walls 24, and the eraser body 18 can be pushed backward or pulled foreward easily, after proper protrusion length of the eraser is set, the eraser body 18 can be pressed back to its normal position, and the front cover 1 is also returned to its locking position, then the eraser device is ready for further erasing operation.

Figure 7:
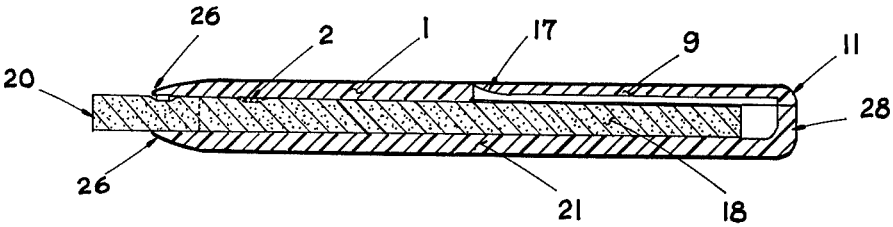
FIG. 7 is an enlarged longitudinal section taken along the line 54—54 from the combination of FIG. 2 and FIG. 3.

Referring particularly to FIG. 7 and FIG. 8, the front end 17 of the rear cover 9 is smoothly tapered at inside face to minimize the friction between the rear cover and the eraser body 18, when the protrusion of the eraser is being adjusted. For long thin flat eraser device, the flexibility makes it more troublesome to refill the eraser body 18, if the rear cover is not removable. By removal of both covers 1 and 9, the eraser body 18 can be easily laid into holder bottom 21, after returning both covers 1 and 9 to their correct positions, the eraser device is ready for use.

Figure 4:
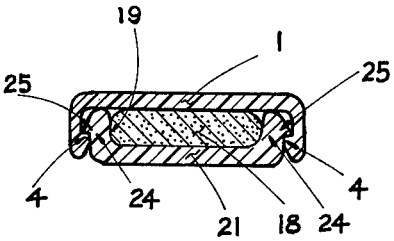
FIG. 4 is an enlarged cross-section taken along the line 51—51 from the combination of FIG. 2 and FIG. 3.
Figure 5:
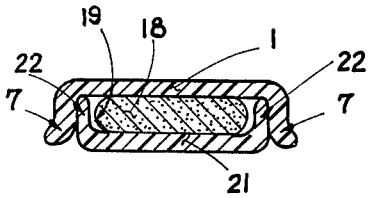
FIG. 5 is an enlarged cross-section taken along the line 52—52 from the combination of FIG. 2 and FIG. 3.
Figure 6:
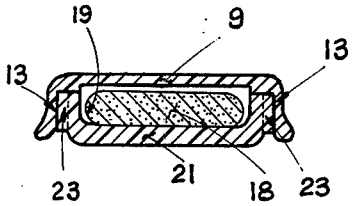
FIG. 6 is an enlarged cross-section taken along the line 53—53 from the combination of FIG. 2 and FIG. 3.

Referring particularly to FIG. 4 to FIG. 6, the eraser body 18 has two smooth round edges 19 to let it be pressed between the clamping side walls 24 easily from either face of eraser body.

I am aware that my improved eraser device can have two erasing ends, if the eraser body 18 is split into two pieces at the junction line of the covers 1 and 9, and both covers and holder bottom should have the clamp action as described clamping zone 29 at each ends of the eraser holder 40.

Also I am aware that my improved eraser device can have two separated plastic hinges, each at one side of the front and the rear covers to replace the said snap clips at that side.

The entire eraser holder 40 can be easily made with tough plastic by injection mold method, the eraser body 18 can be made with rubber-like material. I found that the desirable size of eraser body is approximately ½ inch wide by ⅛ inch thick and 2 inches to 6 inches long.

While in the foregoing, there has been provided a detailed description of a particular embodiment of the present invention, it is to be understood that all equivalent obvious to those having skill in the art are to be included within the scope of the invention as claimed.

I claim:

1. In an eraser device, the combination of: a thin flat eraser having two broad parallel faces, two narrow round side faces and a horizontally curved front face; means for holding the thin flat eraser in adjustable protrusion therefrom including a stiff eraser holder having a horizontally rounded open front end and comprising a front cover of inverted trough shape, a rear cover of inverted trough shape, a holder bottom of upright trough shape for assembly together with said front and rear covers so as to form an erasure enclosure, means for removably snapping the front cover and the rear cover in attachment with the holder bottom, the front cover having means for gripping said eraser upon attachment of the front cover to the holder bottom, the holder bottom having, at a forward location, inward sidewall protrusion for constricting the spacing between the side walls and laterally gripping the eraser, and the holder bottom having lug structure located for preventing the rear cover from sliding out of place forwardly during use of the erasing device.

2. In an eraser device the combination of: a thin flat eraser having two broad parallel faces, two narrow round side faces and a horizontally curved front face; means for holding the thin flat eraser in adjustable protrusion therefrom including a stiff eraser holder having front and rear covers of inverted trough shape and a holder bottom of upright trough-shape, the front end of said eraser holder being open, said holder bottom having: first engaging structures respectively at outside faces of the respective side walls near the front end thereof, a horizontally curved front end to eliminate scratching during erasing when said eraser holder is in an inclined position; protrusive structure near the front end on the underside of said front cover for working together with the inside face at the front end of said holder bottom in clamp action on said broad parallel faces of the thin flat eraser when received between the front cover and holder bottom; , second engaging structures respectively at inside faces of the respective side walls near the front end of said front cover for releasibly connecting with said first engaging structures of said holder bottom in order to create said clamp action at the front end of said eraser holder, the front cover having two smoothly flaring side walls for pressing against to remove the front cover, and a straight-across edge at the rear end of said front cover for butting against the front end of said rear cover to form a smooth holder surface.

3. In the combination of claim 2, said holder bottom having third engaging structures respectively at outside faces of the side walls near the rear end thereof, having: two smoothly flaring side walls for pressing against to remove the rear cover fourth engaging structures respectively at inside faces of the side walls near the rear end of said rear cover for releasibly connecting with said third engaging structure of said holder bottom, creating a rear enclosure space for said thin flat eraser, said rear enclosure space being bigger than the space at the front end of said eraser holder in which said thin flat eraser is received between the front cover and holder bottom so as to permit said thin flat eraser to be pushed backward and pulled forward easily in eraser protrusion adjustment process when said clamp action is released.

4. In the combination of claim 3: said front cover having: a horizontally curved front end conforming to said horizontally curved front end of the holder bottom, said holder bottom having side wall thickness creating a narrower space at the front portion of said holder bottom so as to fit said thin flat eraser snugly and to induce grasping friction to form a clamp action on the narrow faces of said thin flat eraser; respective cover stops at respective outside faces of said holder bottom for butting against the rear end of the side walls of said front cover to receive any reaction force from said front cover when the eraser device is in operation, said cover stops serving as cover position indicators to let the front and rear covers return to said abutting position easily, said cover stops being receivable in respective notches at the front end of the side walls of at said rear cover to form smooth holder surfaces.

* * * * *